US007160078B2

(12) United States Patent
Coign et al.

(10) Patent No.: US 7,160,078 B2
(45) Date of Patent: Jan. 9, 2007

(54) MECHANICAL SOLUTION FOR RAIL RETENTION OF TURBINE NOZZLES

(75) Inventors: Robert Walter Coign, Piedmont, SC (US); David John Humanchuk, Simpsonville, SC (US); Leslie Tucker, Tequesta, FL (US)

(73) Assignee: General Electric Company, Schenectady, NY (US)

( * ) Notice: Subject to any disclaimer, the term of this patent is extended or adjusted under 35 U.S.C. 154(b) by 64 days.

(21) Appl. No.: 10/947,450

(22) Filed: Sep. 23, 2004

(65) Prior Publication Data

US 2006/0062673 A1 Mar. 23, 2006

(51) Int. Cl.
*F01D 21/00* (2006.01)
*F01D 9/04* (2006.01)

(52) U.S. Cl. ..... 415/9; 415/138; 415/139; 415/189; 415/209.2; 415/209.4; 29/889.22

(58) Field of Classification Search ..... 415/136–139, 415/189–190, 209.2, 209.3, 209.4, 9; 29/889.22
See application file for complete search history.

(56) References Cited

U.S. PATENT DOCUMENTS 4,720,236 A * 1/1988 Stevens ..... 415/136
5,839,878 A * 11/1998 Maier ..... 415/209.2
6,609,885 B1 * 8/2003 Mohammed-Fakir et al. ..... 415/191
2005/0111969 A1 * 5/2005 Arness et al. ..... 415/189
2005/0244267 A1 * 11/2005 Coign et al. ..... 415/189

* cited by examiner

*Primary Examiner*—Christopher Verdier
(74) *Attorney, Agent, or Firm*—Nixon & Vanderhye P.C.

(57) ABSTRACT

A mechanical arrangement for protection against catastrophic nozzle failures includes a turbine nozzle segment including an inner platform rail, a turbine nozzle inner support ring in part in axial registration with the rail on one side, an inner retainer segment secured to the inner support ring and in part in axially spaced registration relative to the rail on an axial side of the rail opposite from the support ring, a first inclined conical surface on the inner retainer segment, and a second inclined conical surface on the inner platform rail of the turbine nozzle, the second inclined conical surface opposing the first inclined conical surface, so as to bind the inner platform rail to the turbine nozzle between the inner retainer segment and the inner support ring, resulting in a wedge lock that prevents the inner platform from being lost downstream into rotating hardware of the turbine.

15 Claims, 4 Drawing Sheets

MECHANICAL SOLUTION FOR RAIL RETENTION OF TURBINE NOZZLES

The present invention relates to gas turbines, and in particular, to a mechanical arrangement for the rail retention of turbine nozzles that protects against catastrophic nozzle failures.

BACKGROUND OF THE INVENTION

In gas turbines, thermally induced stresses have always led to cracking in turbine nozzles. Due to the harsh environment, previous field history has shown cracking along the engine axial (chordwise) direction of nozzle airfoils. Should a crack propagate through the entire length of an airfoil, such that the airfoil fails catastrophically, large pieces of the nozzle might dislodge and move downstream into a turbine's rotating hardware. The subsequent damage to the turbine's hardware (both rotating and static) would be both extreme and costly.

In doublet or triplet nozzle designs (2 or 3 airfoils per nozzle segment, respectively), the increased number of airfoils provides a certain amount of insurance against catastrophic failure through the redundancy of multiple load paths. However, with a singlet (single vane segment) nozzle (1 airfoil per segment), if not retained at both platforms, a large section of nozzle, airfoil and/or platform, could be lost into the flowpath, if the airfoil were to crack completely in two.

A typical practice includes stage 1 nozzles positively attached at the outer retaining ring only, which provides axial, radial, and circumferential restraints. At the inner rail of the nozzle, only axial restraint is provided through contact at the nozzle chordal land seal. This chordal land seal concept allows the large transient radial growth differentials, while allowing the nozzle to rotate about the outer retaining ring hook due to axial growth differentials between the inner and outer turbine cases.

A review of aircraft turbine engine designs show positively attached, yet mechanically/structurally compliant designs usually consisting of multiple plates of thin metal attached directly to either end of the nozzle segment in question. A similar attachment scheme would not be feasible for a land-based turbine of this size due to the large differences in mission transient growth between the inner and outer cases (axial and radial). Also, deflection compliant designs (flight weight) do not lend themselves to being robust, given the combination of harsh environment and the number of operational hours required for a land-based turbine when compared to those seen in commercial aircraft engines.

BRIEF DESCRIPTION OF THE INVENTION

The present invention relates to a mechanical arrangement for an inner-rail retention of a singlet nozzle that protects against catastrophic nozzle failures, although it should be noted that the present invention can also be used with doublet or triplet nozzle designs.

In an exemplary embodiment of the invention, there is provided a mechanical arrangement for the inner rail retention of a singlet nozzle to provide protection against catastrophic nozzle failures which includes a turbine nozzle segment having at least one stator vane and including an inner platform rail, a turbine nozzle inner support ring in part in axial registration with said rail on one side thereof, an inner retainer segment secured to said inner support ring and in part in axially spaced registration relative to said rail on an axial side of said rail opposite from said support ring, a first inclined conical surface on the inner retainer segment, and a second inclined conical surface on the inner platform rail of the turbine nozzle, the second inclined conical surface opposing the first inclined conical surface, whereby the two opposing inclined conical surfaces bind the inner platform rail to the turbine nozzle between the inner retainer segment and the inner support ring resulting in a wedge lock that prevents the inner platform of nozzle from being lost downstream into rotating hardware of the turbine.

The present invention also encompasses a method of preventing a catastrophic nozzle failure in a turbine having a plurality of nozzle segments arranged about a turbine axis with each segment having at least one stator airfoil and an inner platform carrying an inner platform rail and inner nozzle support rings in part in spaced axial registration with said rails, the method including the steps of providing a plurality of inner retainer segments secured to said inner supporting rings and in part in axial spaced registration relative to said rails on an axial side of said rails opposite from said support rings, providing a plurality of first inclined conical surfaces on each of the inner retainer segments, and providing a plurality of second inclined conical surfaces on each of the inner platform rails, each second inclined conical surface opposing a corresponding first inclined conical surface, whereby, in response to a structural failure in the turbine nozzle segment, the two opposing inclined conical surfaces contact and bind a corresponding inner platform rail to a corresponding nozzle segment between a corresponding inner retainer segment and a corresponding inner support ring.

DETAILED DESCRIPTION OF THE INVENTION

The present invention is directed to a mechanical arrangement for the inner rail retention of a singlet nozzle to provide protection against catastrophic nozzle failures, although it should be noted that the present invention can also be used with doublet or triplet nozzle designs.

The inner retention design of the present invention solves the lack of inner restraint while maintaining a flexible boundary that allows differential growth/movement between the inner and outer cases of a turbine. The present invention balances the need for ease of installation and removal, with no increase in cooling flow leakage, and provides a focus on domestic object damage ("DOD") resistance.

If a nozzle airfoil for a single airfoil nozzle cracks through completely so as to produce two separate nozzle pieces, the inner retainer of the present invention provides positive retention against complete downstream loss of the inner portion of the failed nozzle to protect against catastrophic nozzle failure. Retention is accomplished by the fact that the inner rail of the nozzle must move radially outboard and then aft into the turbine flowstream. Through the use of opposing incline surfaces, one on the retainer and the other on the nozzle inner rail, a wedge lock is accomplished which holds the inner nozzle in place. Thus, even if the inner nozzle platform rotates backward and potentially causes a rub on the stage 1 bucket platform leading edge, the failure mode is much less severe than a complete loss of large pieces of hardware.

Figure 1:
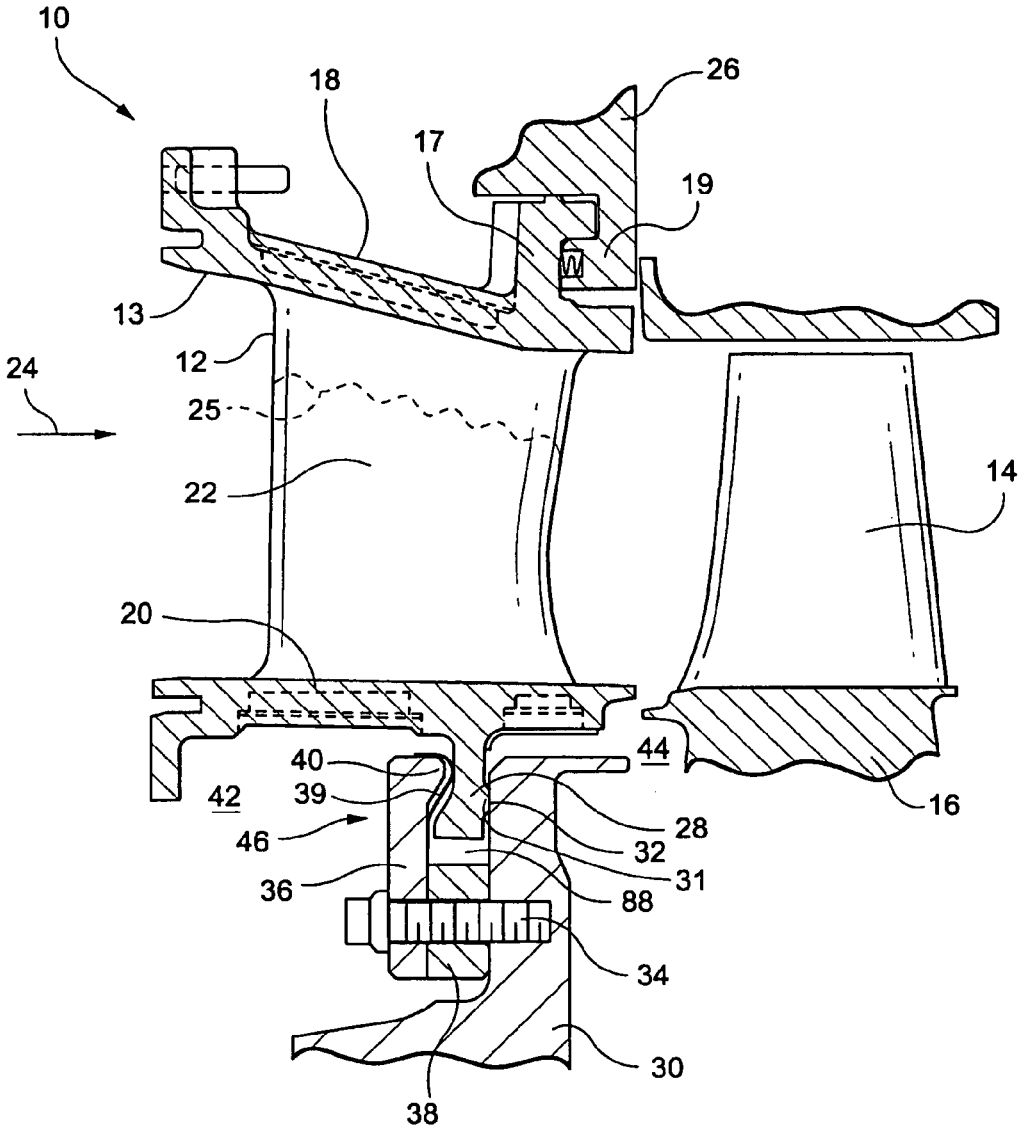
FIG. 1 is a schematic cross-sectional view showing the positional relationship of the inner retainer to the surrounding hardware of a 6C turbine, and in particular, the first stage of such a turbine.
Figure 2:
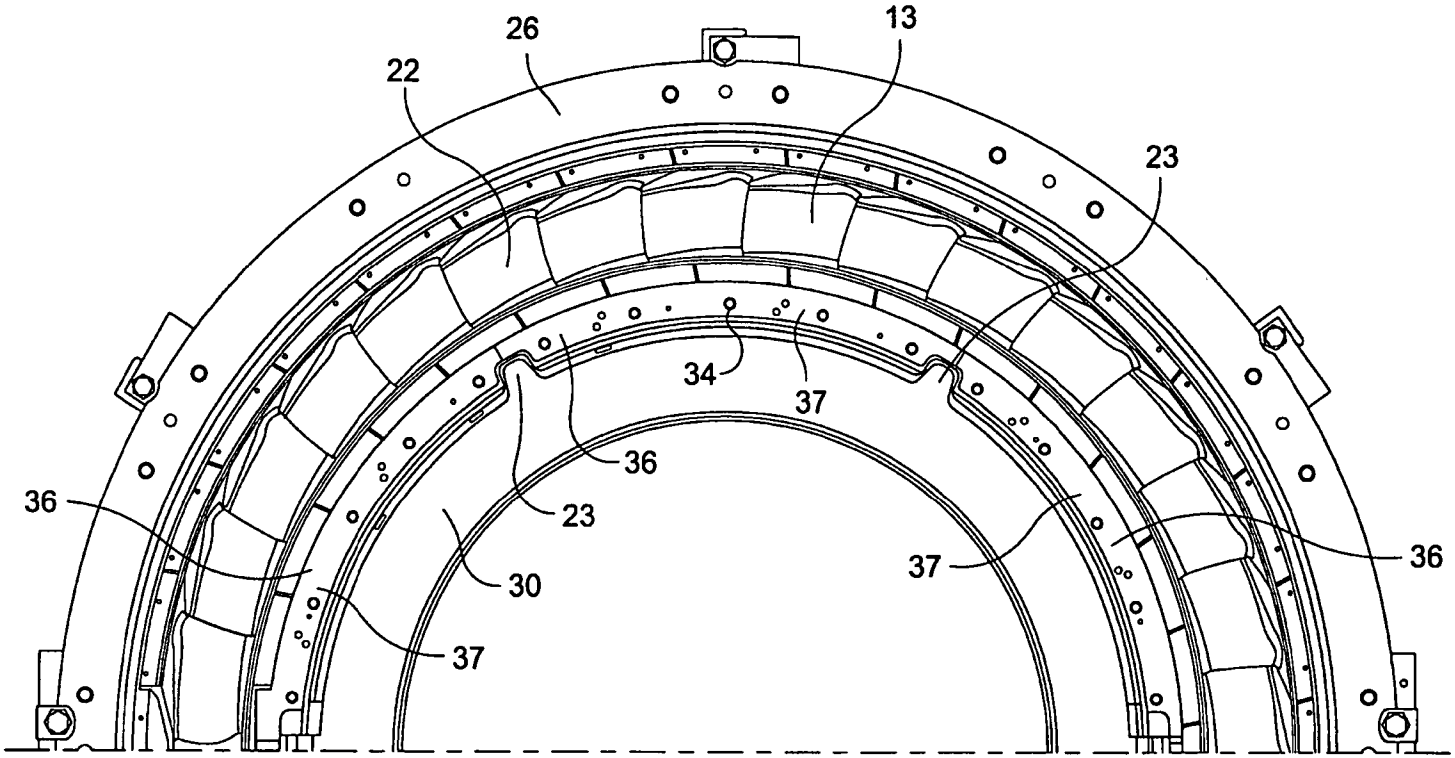
FIG. 2 is a schematic frontal view (upper half only) of the inner retainer as applied to a 6C turbine, which shows the inner support ring flanges that require multiple segments around the diameter.

Referring now to the drawings, illustrated in FIG. 1 is a cross-sectional view of a first stage turbine section 10 of a 6C turbine (not shown), which includes a first stage nozzle 12 and a first stage bucket 14 forming part of a rotor 16. FIG. 2 illustrates a front view of first stage nozzle 12's segments. Nozzle 12 is formed from a plurality of nozzle segments 13, including an outer band or platform 18, an inner band or platform 20, and one or more airfoils 22 extending between platforms 18 and 20. As is well known, the nozzle airfoils 22, as well as the buckets 14, extend in the hot gas path of the turbine, the hot gas path having a flow direction designated by the arrow 24 in FIG. 1. Airfoils 22 and buckets 14 are arranged in annular arrays about an axis of the turbine. Outer platform 18 of each nozzle segment 13 is secured to an outer retaining ring 26. Each of the nozzle segments includes a radially inwardly directed inner platform rail 28, the aft face of which bears against an inner support ring 30 precluding axial movement in an aft direction. Conventionally, the aft face of each rail 28 has an arcuate projecting land 31 for sealing against the forward axial face of the inner support ring 30, the rails 28 forming an annular chordal seal about the upper and lower halves of the support ring 30. Each of the chordal land seals 32 typically comprises a narrow raised arcuate land 31 integral to the face of the rail 28 forming with adjacent nozzles a complete circumferential array of chordal land seals 32 bearing against the support rings 30.

Also secured to the inner support ring 30, by a plurality of circumferentially spaced bolts or pins 34, are a plurality of arcuate inner retainer segments 36. Segments 36 are axially spaced from the support rails 28 by a plurality of arcuate inner retainer spacers 38. It should be noted that each of the arcuate inner retainer spacers 38 can be part of the support ring 30, or alternatively, part of the retainer segment 36. The radial outer margins 40 of the inner retainer segments 36 are axially enlarged in a direction toward the inner support ring 30, but are spaced from the rails 28 extending between the retainer segments 36 and support ring 30. Likewise, the radial inner margins of the inner platform rails 28 are axially enlarged in a direction away from the inner support ring 30.

In an exemplary embodiment of the present invention, there are thirty-two nozzle segments 13 forming an annular array of nozzle airfoils 22 about the turbine axis and preferably six each of the inner retainer segments 36 and inner retainer spacers 38, each of the segments 36 and the spacers 38 being disposed in an annular array about the axis of the turbine. As will be appreciated, the region 42 forward of the inner retainer segments 36 receives cooling air, i.e., compressor discharge air under high pressure, and it is essential to seal the high pressure region 42 from the lower pressure region 44 adjacent to the forward rotor rim cavity and also the hot gas path outboard of the rim cavity.

Referring again to FIG. 1, first stage nozzle 12 is supported at outer platform 18 by an outer rail hook 17 to an aft hook 19 of outer retaining ring 26. Inner platform 20 is supported at chordal land seal 32 of an inner platform rail 28 by contact with inner support ring 30. An inner retainer 36 is comprised of a plurality of segments, and is bolted and pinned through a plurality of seals 39 and spacers 38 to inner support ring 30.

Referring to FIG. 2, a portion of the first stage nozzle segments are shown in positional relation to outer retaining ring 26 and inner support ring 30. For clarity, only the upper half of such nozzle segments are shown in FIG. 2, but may be extended 180° about the engine center line for a complete graphical representation of such nozzle segments. Multiple support ring flanges/ribs 23, which require multiple inner retaining segments 37, can be seen in FIG. 2.

Inner retainer ring 36 consists of six separate plate segments 37 whose arc lengths are sized to accommodate raised structural flanges/ribs 23 on inner support ring 30. Although complicating the design, the segmentation of retainer 36 allows for ease of installation, even with a turbine's outer shell installed. After installation of nozzle 12, each inner retainer 36 is installed from the front and then bolted through a seal 39 and a spacer 38 to inner support ring 30. Close tolerance dowel pins 34 (FIG. 1) are used to carry a failed nozzle 12 load via shear through the support ring 30.

A typical failure mode would be a crack 25 in airfoil 22 of nozzle 12 that propagates completely through airfoil 22. Crack 25, as shown in FIG. 1, is only illustrative, and could occur anywhere along the span of nozzle 12. If such a crack 25 were to occur, nozzle 12 would separate into two pieces, i.e., outer platform 18 and inner platform 20, respectively, each containing a particular segment of nozzle 12's airfoil 22. With such a separation in a prior turbine design, inner platform 20 would become loose hardware without the addition of inner retainer ring 36 to provide restraint at inner rail 28.

Figure 3:
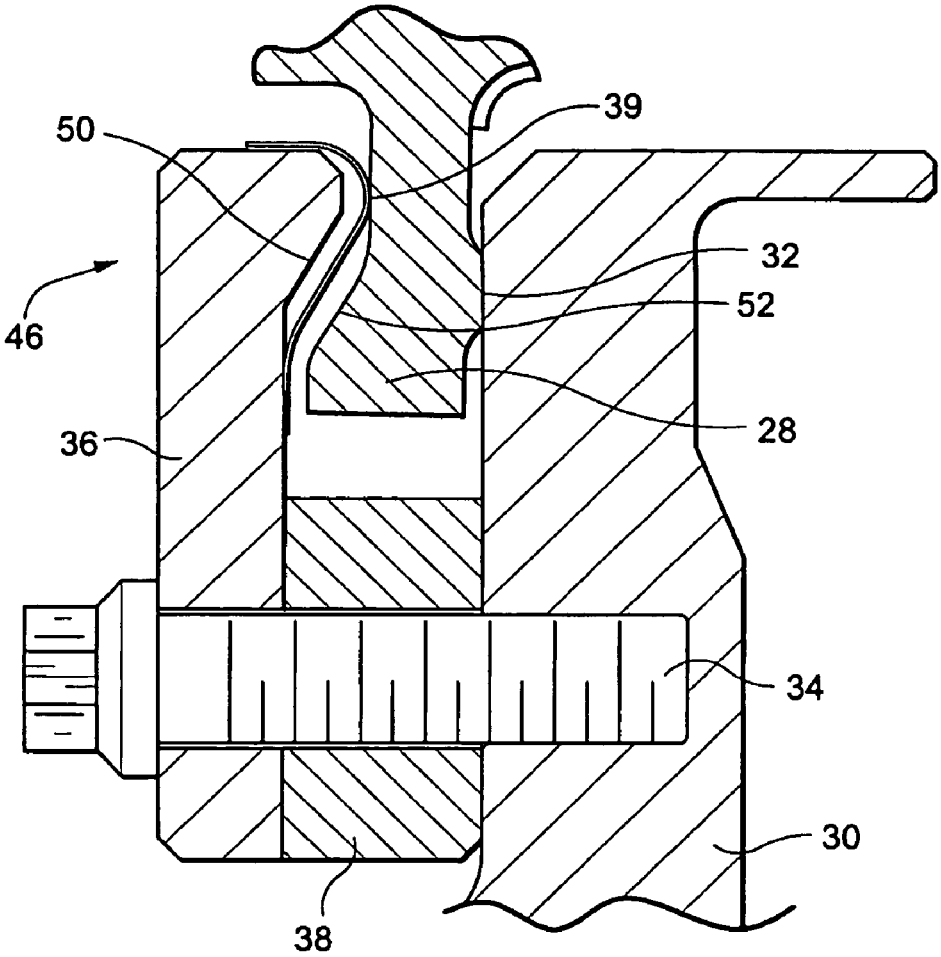
FIG. 3 is a more detailed schematic cross-sectional view of the inner retainer mechanical arrangement of the present invention showing the positional relationship of the inner retainer to the surrounding turbine hardware, including the stage 1 nozzle, inner support ring, spacer, and seal, as applied in the 6C type of turbine.

Referring to FIG. 3, a more detailed schematic cross-sectional view of inner retainer ring 36 is provided, showing the positional relationship of inner retainer 36 to the surrounding hardware, including the stage 1 nozzle inner rail 28, inner support ring 30, and spacer 38 and seal 39, as applied in a 6C turbine. Although inner retainer ring 36 is mounted in close proximity to nozzle inner rail 28, there is no direct contact between the two parts. The gaps between inner retainer ring 36 and nozzle inner rail 28 are optimized to be at a minimum, yet allow nozzle 12 to move through its complete range of transient motion. With no physical contact between the inner retainer ring 36 and nozzle inner rail 28, the retention function is performed by two opposing inclined conical surfaces, i.e., one surface 50 on the inner retainer 36 and one surface 52 on the inner rail 28 of nozzle 12. Also, with no physical contact, the inner retainer 36 provides no impact on cooling air leakage across the nozzle chordal land seal 32.

Figure 4:
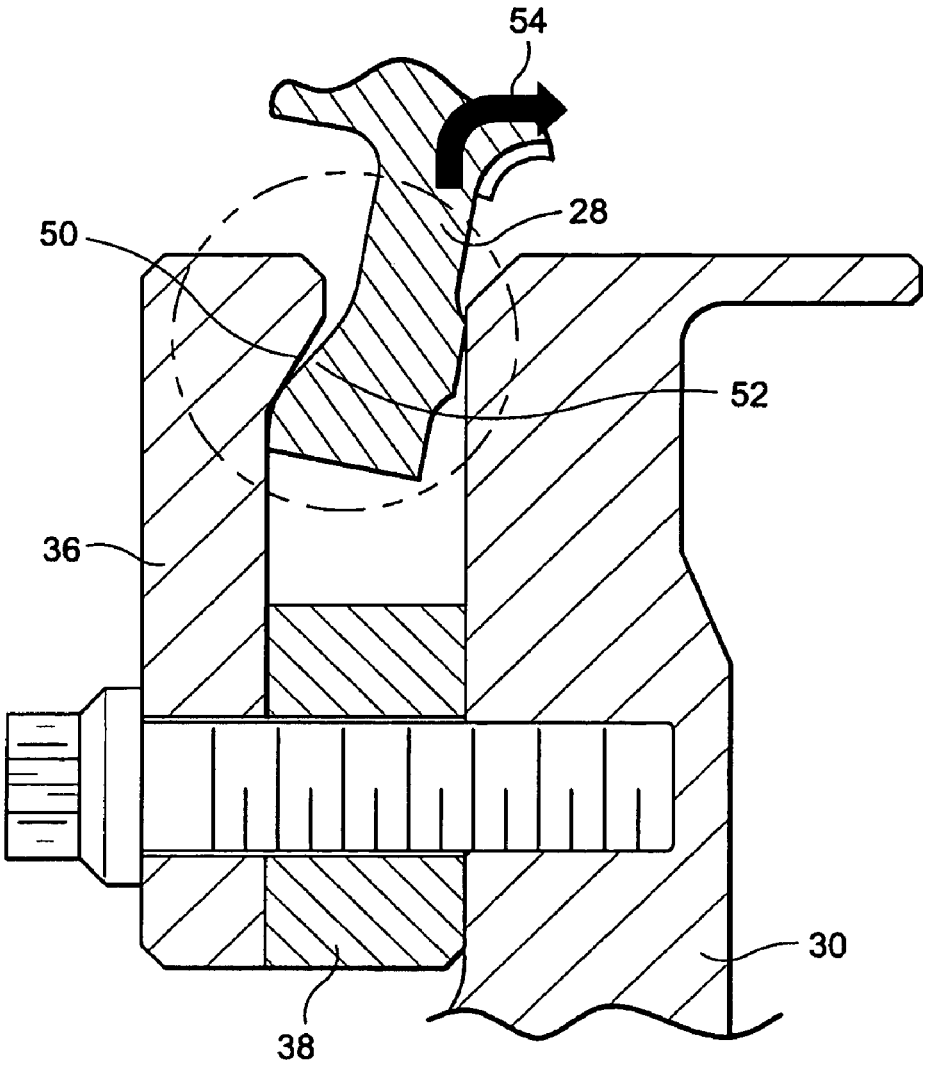
FIG. 4 shows the arrangement of FIG. 3 in a post failure situation, where the liberated nozzle inner platform/rail is wedged between the inner retainer and the inner support ring.

FIG. 4 shows a post failure situation for the arrangement shown in FIG. 3 wherein the liberated nozzle inner rail 28 is wedged between inner retainer 36 and inner support ring 30. The inner retainer seal 39 has been removed from the view shown in FIG. 4 for clarity purposes. During the occurrence of a failure, such as crack 25 in vane 22 of nozzle 12, the remaining balance of inner platform 20 (see FIG. 1) of nozzle 12 would have to move radially outboard away from the engine centerline and then downstream, as shown by arrow 54 in FIG. 4. When this occurs, the two opposing inclined surfaces, 50 and 52, contact and bind the inner rail 28 between the inner retainer 36 and inner support ring 30. The resulting wedge lock shown in the dashed circle in FIG. 4 prevents inner platform 20 of nozzle 12 from being lost downstream into rotating hardware, such as the stage 1 bucket 36, to thereby protect against catastrophic nozzle failure.

The present invention also encompasses a method of preventing a catastrophic nozzle failure in a turbine having a plurality of nozzle segments 13 arranged about a turbine axis with each segment 13 having at least one stator airfoil 22 and an inner platform 20 carrying an inner platform rail 28 and inner nozzle support rings 30 in part in spaced axial registration with the rails 28. The method includes the steps of providing a plurality of inner retainer segments 36 secured to the inner supporting rings 30 and in part in axial spaced registration relative to the rails 28 on an axial side of the rails opposite from the support rings 30, providing a plurality of first inclined conical surfaces 50 on each of the inner retainer segments 36, and providing a plurality of second inclined conical surfaces 52 on each of the inner platform rails 28, each second inclined conical surface 52 opposing a corresponding first inclined conical surface 50, such that in response to a structural failure in the turbine nozzle segment 13, the two opposing inclined conical surfaces contact and bind a corresponding inner platform rail 28 to a corresponding nozzle segment 13 between a corresponding inner retainer segment 36 and a corresponding inner support ring 30.

While the inner rail retention mechanical arrangement of the present invention has particular application with singlet nozzles in providing protection against catastrophic nozzle failures, as noted above, the present invention can also be used with doublet or triplet nozzle designs.

Similarly, although the inner rail retention mechanical arrangement of the present invention has been described with reference to a 6C type of turbine, it can be used with other types of turbines. Modifications to for other engine applications could include 1) a different number and length of retainer segments (as opposed to the 6 at approximately 60 degrees matched to the 6C turbine), since more or less may be desirable in other engines, 2) scaling up or down of parts to match a given engine size, 3) eliminating spacer 38 so that it becomes part of support ring 30, or combining it into retainer plate 36 as one piece, 4) changing the angle or shape of inclined surfaces 50 and 52, and 5) if nozzle 12 is inverted or attached at an outer platform rail instead of inner platform rail 28, as in the 6C turbine, retainer 36 could be used at the outer rail. Similar to the embodiment of the invention described for the 6C turbine, in the embodiment where nozzle 12 is inverted, the outer rail would bear against an outer support ring, and there would be a plurality of arcuate outer retainer segments like retainer 36 spaced from the outer support rail by a plurality of arcuate outer retainer spacers. The radial inner margins of the outer retainer segments would also be axially enlarged in a direction toward the outer support ring and the radial outer margins of the outer platform rail is axially enlarged in a direction away from the outer support ring.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine comprising:

a turbine nozzle segment having at least one stator airfoil and including an inner platform rail;

a turbine nozzle inner support ring in part in axial registration with said rail on one side thereof;

an inner retainer segment secured to said inner support ring and in part in axially spaced registration relative to said rail on an axial side of said rail opposite from said support ring;

a first surface on the inner retainer segment; and a second surface on the inner platform rail, the second surface opposing the first surface;

whereby, in response to a structural failure in the turbine nozzle segment, the two opposing surfaces contact and bind the inner platform rail to the turbine nozzle between the inner retainer segment and the inner support ring.

2. A turbine according to claim 1 wherein the contacting of the first and second surfaces results in a wedge lock that prevents the inner platform of the nozzle segment from being lost downstream into rotating hardware of the turbine.

3. A turbine according to claim 1 wherein the first and second surfaces are inclined surfaces.

4. A turbine according to claim 3 wherein the first and second surfaces are conical surfaces.

5. A turbine according to claim 1 wherein the radial outer margin of the inner retainer segment is axially enlarged in a direction toward the inner support ring.

6. A turbine according to claim 5 wherein the radial outer margin of the inner retainer segment is also spaced from the rail extending by at least one arcuate inner retainer spacer between the retainer segment and the inner support ring.

7. A turbine according to claim 5 wherein the first surface on the inner retainer segment is located on the radial outer margins of the inner retainer segment.

8. A turbine according to claim 5 wherein the radial inner margin of the inner platform rail is axially enlarged in a direction away from the inner support ring.

9. A turbine according to claim 8 wherein the second surface on the inner platform rail is located on the radial inner margin of the inner platform rail.

10. A turbine comprising:

a plurality of nozzle segments arranged about a turbine axis with each segment having at least one stator airfoil and an inner platform carrying an inner platform rail;

inner nozzle support rings in part in spaced axial registration with said rails and on one axial side of said rails;

a plurality of inner retainer segments secured to said inner supporting rings and in part in axial spaced registration relative to said rails on an axial side of said rails from said support rings;

a first inclined conical surface on each of the inner retainer segments; and a second inclined conical surface on each of the inner platform rails;

each second inclined conical surface opposing a corresponding first inclined conical surface, whereby, in response to a structural failure in the turbine nozzle segment, the two opposing inclined conical surfaces contact and bind a corresponding inner platform rail to a corresponding nozzle segment between a corresponding inner retainer segment and a corresponding inner support ring.

11. A turbine according to claim 10, wherein the contacting of the first and second surfaces results in a wedge lock that prevents the inner platform of the nozzle segment from being lost downstream into rotating hardware of the turbine.

12. A method of preventing a catastrophic nozzle failure in a turbine having a plurality of nozzle segments arranged about a turbine axis with each segment having at least one stator airfoil and an inner platform carrying an inner platform rail and inner nozzle support rings in part in spaced axial registration with said rails, comprising the steps of:

providing a plurality of inner retainer segments secured to said inner supporting rings and in part in axial spaced registration relative to said rails on an axial side of said rails opposite from said support rings;

providing a plurality of first inclined conical surfaces on each of the inner retainer segments; and providing a plurality of second inclined conical surfaces on each of the inner platform rails, each second inclined conical surface opposing a corresponding first inclined conical surface;

whereby, in response to a structural failure in the turbine nozzle segment, the two opposing inclined conical surfaces contact and bind a corresponding inner platform rail to a corresponding nozzle segment between a corresponding inner retainer segment and a corresponding inner support ring.

13. A turbine according to claim 1 wherein the retainer segment is axially spaced from the rail by an arcuate inner retainer spacer.

14. A turbine according to claim 1 wherein the spacer is part of the support ring.

15. A turbine according to claim 1 wherein the spacer is part of the retainer segment.

* * * * *